United States Patent [19]

Werner et al.

[11] Patent Number: 4,498,084

[45] Date of Patent: Feb. 5, 1985

[54] FOUR WIRE DUAL MODE SPIRAL ANTENNA

[75] Inventors: William L. Werner, Cupertina; Raymond H. DuHamel, Mountain View, both of Calif.

[73] Assignee: Granger Associates, Santa Clara, Calif.

[21] Appl. No.: 454,693

[22] Filed: Dec. 30, 1982

[51] Int. Cl.[3] ..... H01Q 1/36; H01Q 11/10

[52] U.S. Cl. ..... 343/792.5; 343/891; 343/895

[58] Field of Search ..... 343/792.5, 886, 890, 343/891, 895, 908

[56] References Cited

U.S. PATENT DOCUMENTS 3,683,390 8/1972 Cory et al. ..... 343/792.5

3,906,509 9/1975 DuHamel ..... 343/895

*Primary Examiner*—Eli Lieberman

*Attorney, Agent, or Firm*—Flehr, Hohbach, Test, Albritton & Herbert

[57] ABSTRACT

A dual mode broadband antenna especially designed to provide an omni-directional low angle or high angle radiation pattern which is predominately horizontally polarized is disclosed herein. This antenna utilizes four wire radiators in the form of an inverted conical log-spiral supported in a vertically extending fashion a predetermined distance above the horizontal ground plane. In order to alternatively operate the antenna in its high and low angle modes, first and second oppositely phased AC currents are applied to the radiators in two different ways using a simple switching device rather than a more complicated network of four hybrid circuits.

16 Claims, 10 Drawing Figures

FOUR WIRE DUAL MODE SPIRAL ANTENNA

The present invention relates generally to antennas and more particularly to one which is specifically designed to operate in two different modes for providing omni-directional, low angle or high angle radiation patterns in order to achieve medium and long range coverage in a ground supported position.

There are many different types of ground supported antennas for providing low angle and/or high angle radiation patterns in order to achieve different ranges of coverage. For example, TCI 540 antenna by Technology for Communications International described in their brochure dated November, 1978 and entitled "MODEL 540 Omni-Gain Antenna TM utilizes eight periodic arrays to provide a low angle, omni-directional high frequency pattern. A high angle antenna is provided by the Granger Associates Model 798 described in their U.S. Pat. No. 3,376,577. This antenna is a two-element logarithmic spiral which is limited to short range application. Also, while this particular antenna is described as a conical array, its cone angle is so large that it essentially acts as a planar spiral having a bi-directional free space radiation pattern rather than a uni-directional pattern as would be provided by a small angle cone. Still other two and four element antennas, specifically log-spiral antennas, are described in the following publications:

ANALYSIS OF MULTIPLE-ARM CONICAL LOG SPIRAL ANTENNAS, *IEEE Transactions on Antennas and Propagation,* Vol. AP-19, No. 3, May 1971, Pages 320–331.

THE CHARACTERISTICS AND DESIGN OF THE CONICAL LOG-SPIRAL ANTENNA, *IEEE Transactions on Antennas and Propagation,* July 1965, Pages 488–499.

NEW CIRCULARLY-POLARIZED FREQUENCY-INDEPENDENT ANTENNAS WITH CONICAL BEAM OR OMNIDIRECTIONAL PATTERNS, *IRE Transactions on Antennas and Propagations,* July 1961, Pages 334–342.

THE LOGARITHMIC SPIRAL IN A SINGLE-APERTURE MULTIMODE ANTENNA SYSTEM, *IEEE Transactions on Antennas and Propagation,* Vol. AP-19, No. 1, January 1971, Pages 90–96.

There are many different types of antennas including specifically spiral type antennas in the prior art as exemplified by those referred to above. However, there are none that applicants are aware of which are individually capable of operating in an uncomplicated and yet reliable manner to provide, alternatively, two different ranges of omni-directional coverage within a relatively broad bandwidth including relatively low frequencies using a relatively simple ground supported physical structure which takes up a relatively small amount of space. It is therefore an object of the present invention to provide an individual antenna of the type.

A more specific object of the present invention is to provide a ground supported antenna using four wire radiators which form an inverted, conical logarithmic-spiral (log-spiral) capable of operating in two alternate modes for providing either omni-directional low angle or high angle radiation patterns.

Another specific object of the present invention is to provide the alternate operating modes just recited using an uncomplicated and readily providable power feed arrangement.

Still another specific object of the present invention is to provide this uncomplicated and readily providable feed arrangement even though the antenna uses all four of its radiators individually when operating in its low angle mode while the same four radiators must be converted by the feed arrangement to a two radiator spiral when operating in its high angle mode.

Yet another specific object of the present invention is to provide an omni-directional broadband antenna formed from a ground supported, inverted conical log-spiral which is particularly configured physically to produce a predominantly horizontally polarized radiation pattern in its low angle mode rather than a circularly polarized pattern normally associated with logarithmic spiral antennas.

Still another specific object of the present invention is to extend the low frequency cut-off of the antenna just recited to lower frequencies than would normally be possible by using only its four radiators without extending the latter radially and therefore the cone defined by these radiators.

A further specific object of the invention is to provide an antenna of the last-mentioned type which only requires a single structural tower for supporting its inverted cone thereby minimizing spatial requirements.

Still a further object of the present invention is to utilize the single tower concept just recited to provide an antenna which achieves higher gain at higher operating frequencies by supporting a second inverted spiral cone on the tower such that the two cones are in stacked relationship to one another.

As will be described in more detail hereinafter and as discussed briefly above, the antenna disclosed herein takes the form of a four radiator inverted conical log-spiral. More specifically, means are provided for supporting first, second, third and fourth wire radiators in electrically insulated relationship to one another around the surface of an imaginary inverted cone. The cone is supported vertically on a horizontal ground plane and has its apex located a fixed distance above that plane. Moreover, the four radiators defining this cone, starting with the first one, are supported so as to provide successively interlaced spiral windings beginning at the lowermost ends of the radiators adjacent the apex of the cone and ending at their uppermost ends adjacent the cone's inverted base. Both the lowermost ends and the uppermost ends of these radiators are circumferentially spaced 90° from one another about the cone's central axis. In addition to these components, the overall antenna includes a power feed arrangement which utilizes first and second alternating currents having the same amplitude and a given frequency but 180° out of phase with one another.

In accordance with one feature of the present invention, the feed arrangement just recited includes means for simultaneously electrically connecting the first alternating current to the lowermost ends of the first and second radiators (e.g., one pair of adjacent radiators) and the second alternating current to the lowermost ends of the third and fourth radiators (e.g., a second pair of adjacent radiators). In this way, the four individual radiators are functionally converted to a single pair for producing a high angle radiation pattern relative to the horizontal ground plane. This utilization of a four radiator configuration to form a two element conical spiral has been found to display improved omni-directional characteristics over an antenna starting with two radiators.

In accordance with another feature of the present invention, the feed arrangement includes a simple switch, for example, a vacuum-type of double pole double throw relay switch, for alternatively operating the antenna in the high angle mode just recited and in a second mode. With the antenna in this second mode, one of the alternating currents is connected to the lowermost ends of the first and third radiators (a first pair of opposite ones) while the other alternating current is connected to the lowermost ends of the second and fourth radiators (a second pair of opposite ones). This causes the antenna to operate as a four element spiral to produce a low angle radiation pattern relative to the horizontal.

In accordance with still another feature of the present invention, the imaginary cone defined by the spiral radiators has a preselected cone angle and the spiral windings define a preselected pitch angle such that the low angle radiation pattern just mentioned is predominantly horizontally polarized.

In accordance with yet another feature of the present invention, means are provided for physically extending the radiating capability of the four radiators for reducing the low frequency cut-off of the antenna without having to increase the radius of the spiral defined by the radiators.

All of the features just mentioned and others will become more apparent from the following detailed description of the antenna disclosed herein in conjunction with the drawings, wherein.

Figure 1:
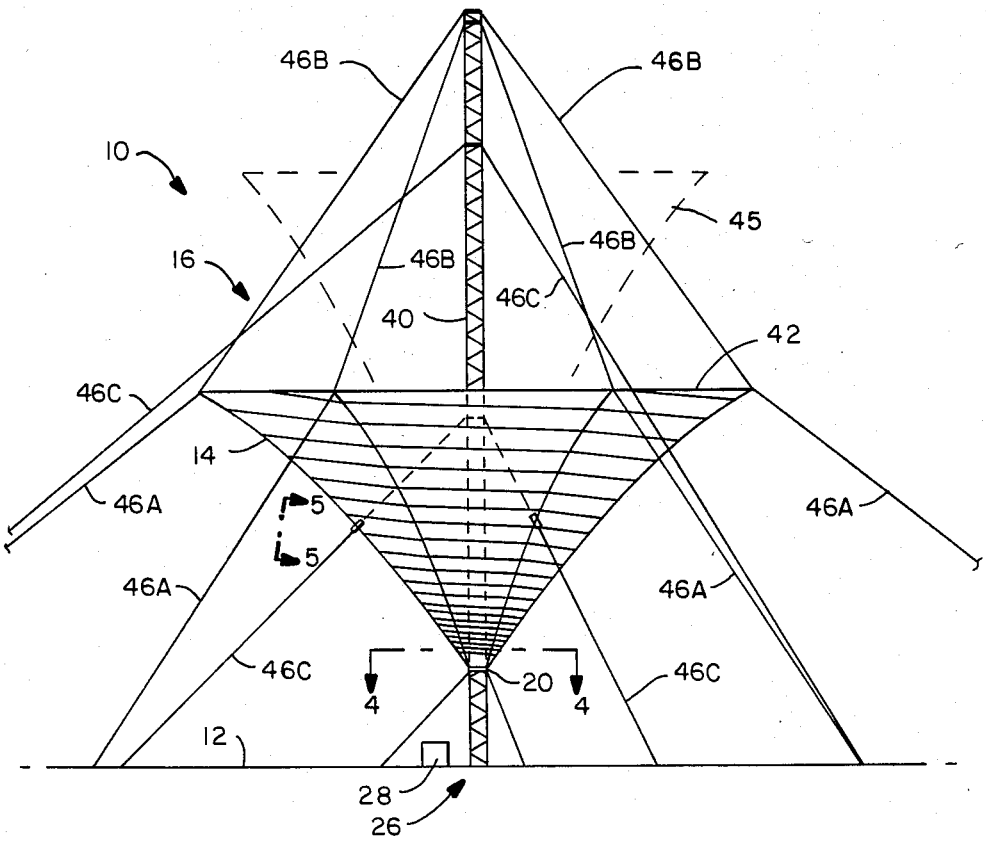
FIG. 1 is a front elevational view of the antenna.
Figure 3:
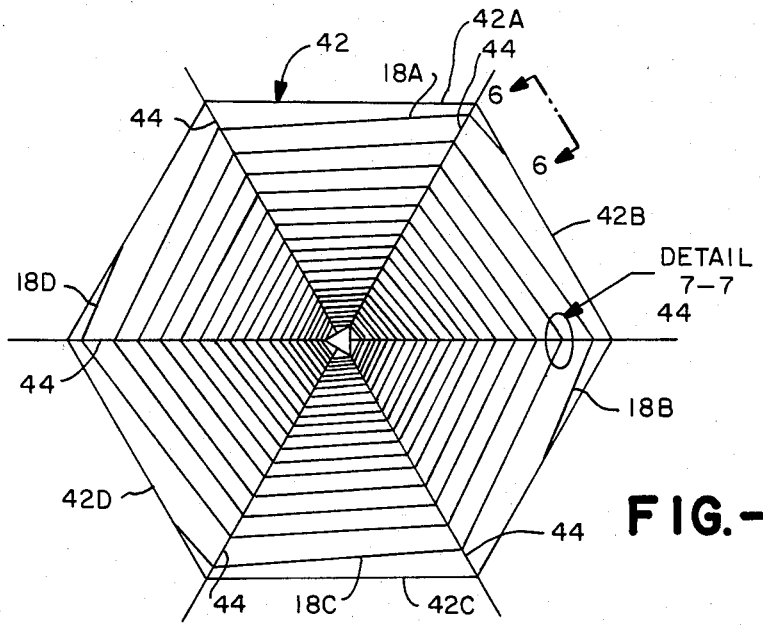
FIG. 3 is a top plan view of the antenna illustrated in FIG. 1.
Figure 7:
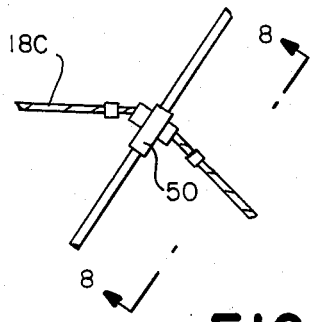
Figure 8:
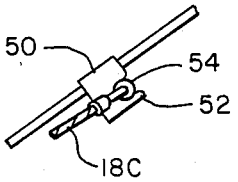
Figure 9:
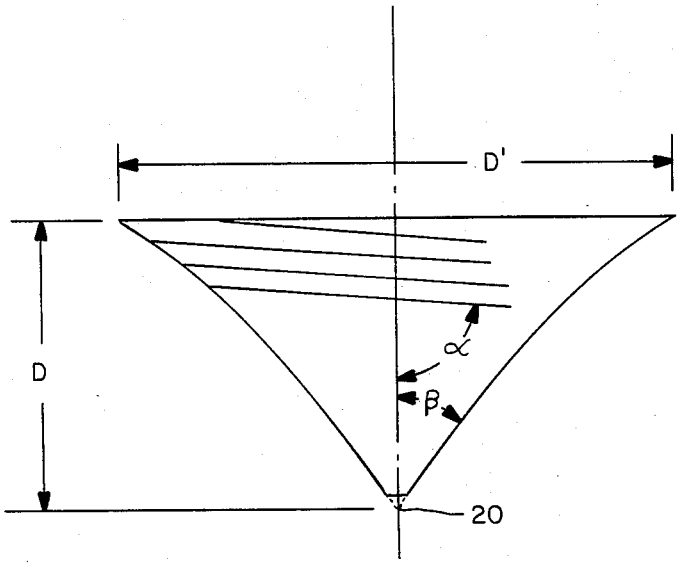

FIG. 7 illustrates still another enlarged detail of the antenna taken generally along line 7—7 in FIG. 3; and FIG. 8 illustrates a detail of the antenna taken generally along line 8—8 in FIG. 7; and FIG. 9 diagrammatically illustrates how the antenna of FIG. 1 actually defines a cone having a given cone angle and how the radiators forming the antenna define spiral windings having a given pitch angle.

Turning now to the drawings, wherein like components are designated by like reference numerals throughout the various figures, attention is first directed to FIG. 1 which illustrates an antenna 10 located on a horizontally extending ground plane 12 which may actually be ground level or it could be a raised support surface such as the roof of a building. The antenna may be divided into a radiating section 14 which, as will be seen hereinafter, is in the form of a four element (radiator) inverted conical log-spiral (hereinafter referred to as a radiating cone) and a support section 16 for maintaining the central axis of the spiral cone in a vertically extending direction and its apex a predetermined distance above the ground plane. As will be described in more detail hereinafter, antenna 10 is designed to operate in two alternate modes, one providing a low angle, omni-directional radiation pattern and the other providing a high angle, omni-directional radiation pattern. The low angle pattern is best illustrated by the low angle lobes in the elevation pattern shown in FIG. 2 and the high angle pattern is best illustrated by the high angle lobe shown there. It should be especially apparent from FIG. 2 that antenna 10 is capable of radiating at elevation angles from zenith to its lowest lobe within a relatively broad bandwidth of 2 MHz (its low frequency cut-off) to 30 MHz (its high frequency cut-off). While the antenna produces nulls in its pattern in one mode, the nulls become peaks in the other mode, thereby providing complete coverage. Moreover, as will be seen, the antenna is specifically configured so that its low angle pattern is predominantly horizontally polarized which has the advantage of achieving greater gain than if vertical or circular polarization is used. This follows because the ground reflection coefficient is much greater for horizontal than vertical polarization. At low angles this provides 4 to 5 dB more gain for horizontal polarization than vertical polarization.

Figure 4A:
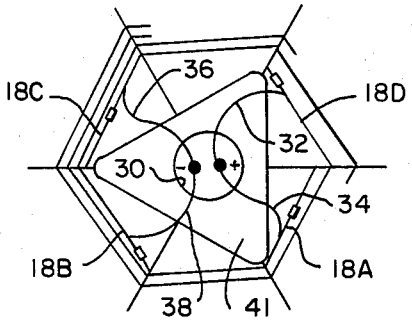
FIGS. 4A and 4B are the same sectional views taken generally along line 4—4 in FIG. 1, but illustrating the connection to radiating elements of the antenna in its high and low angle operating modes, respectively.
Figure 4B:
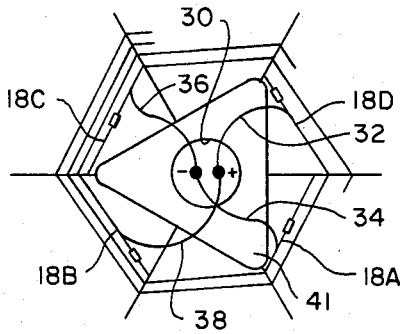

Referring to FIGS. 3 and 4A, 4B in conjunction with FIG. 1, the radiating section 14 of antenna 10 is shown including four wire radiators 18*a*,18*b*,18*c* and 18*d*. These radiators are supported by arrangement 16 in electrically insulated relationship to one another above horizontal ground plane 12 and around the surface of an imaginary inverted cone (specifically the hexagonal cone shown) having its apex 20 located a fixed distance above the ground plane and its central axis 22 extending vertically upward therefrom. The radiators 18*a*,18*b*,18*c* and 18*d* specifically define successively interlaced spiral windings beginning at the lowermost ends of the radiators adjacent apex 20 and ending at their uppermost ends adjacent the inverted base 24 of the cone. A specific formulated definition for these spiral windings can be found in the July, 1965 publication recited above and reference is made thereto. As best illustrated, in FIGS. 4A and 4B the lowermost ends of these radiators are circumferentially spaced 90° from each other about central axis 22. As best seen in FIG. 3, there uppermost ends are also circumferentially spaced 90° from each other about the central axis. In actuality, the four radiators are identical or substantially identical in spiral configuration and are placed on the outer surface of the cone but rotated 90° relative to one another. In a preferred embodiment, the radiators 18 define a logarithmic spiral, although an Arcamedes spiral could be utilized.

Antenna 10 also includes a power feed arrangement which is generally indicated at 26 in FIG. 1. This feed arrangement includes a power station 28 located for example on ground plane 12 adjacent the apex 20 of radiating cone 14. The power station includes suitable means for providing first and second alternating currents having the same amplitude and a given frequency within the bandwidth recited above, but 180° out of phase with one another. As best illustrated in FIGS. 4A and 4B, the feed arrangement also includes a switch 30, for example a vacuum type of double pull double throw relay switch, which connects the lowermost ends of the wire radiators to the two AC currents in alternating high angle and low angle modes for selectively producing the previously described high angle and low angle radiation patterns.

More specifically, as illustrated in FIG. 4A, when the switch 30 is in its high angle position, it connects the lowermost ends of one directly adjacent pair of radiators, for example radiators 18*a* and 18*d*, to one of the AC currents by means of leads 32,34, and it connects the lowermost ends of the other pair of directly adjacent radiators, for example radiators 18*b* and 18*c*, to the other AC current by mens of leads 36,38. This functionally results in a two radiator spiral antenna (using all four radiators). As illustrated in FIG. 4B, when the switch is in its low angle position, it connects one of the AC currents to the lowermost ends of one pair of opposing radiators, for example radiators 18*a* and 18*c*, by means of electrical leads 34 and 36, while, at the same time, the other AC current is connected to the lowermost ends of the other pair of opposing radiators, for example radiators 18*b* and 18*d*, by leads 32 and 38. This functionally results in the previously described four radiator antenna.

Figure 2:
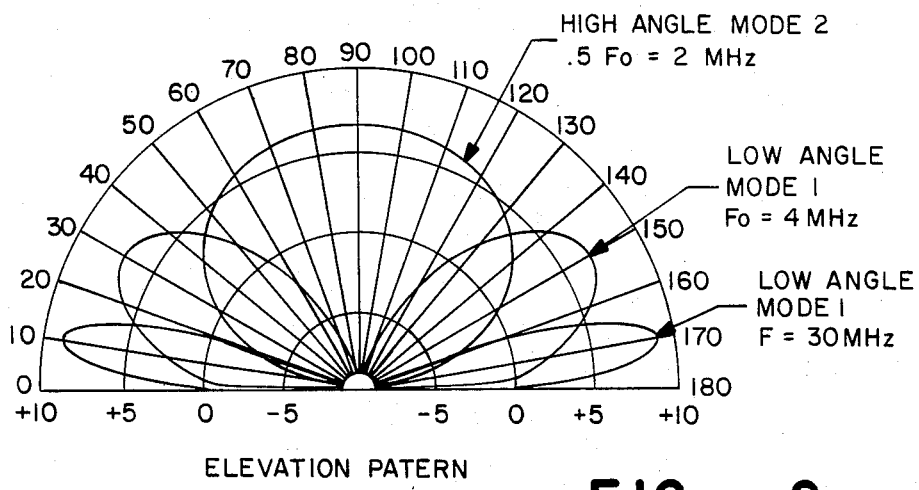
FIG. 2 shows elevation radiation patterns for the high and low angle operating modes of the antenna illustrated in FIG. 1.

From the preceding description it should be apparent that all four of the radiators 18 are used individually, that is, as a four element spiral antenna, to provide the low angle radiation pattern shown in FIG. 2. At the same time, the relatively simple switch 30 can be used to rapidly and reliably convert this four element spiral antenna into a two element spiral to provide high angle radiation without resorting to more sophisticated and expensive switching equipment to provide the 0°, 90°, 180°, 270° of the arms required for the high angle mode. To achieve this phasing and the phasing required for the low angle mode requires a feed network consisting of three Magic T's and a quadrature hybrid coupler. The present system requires only a balen and the above-mentioned switch. This is because applicants have found that both the four element and two element spirals can effectively operate on the alternating currents described to produce the desired radiation patterns and these currents do not require more than a simple switching mechanism such as the switch 30 in order to operate between the two modes described.

Returning to FIG. 1 in conjunction with FIGS. 5–8, attention is now directed to support arrangement 16. As shown in these figures, the arrangement includes a single support tower 40 which is cemented into or otherwise reliably fixed on ground plane 12 and which extends vertically upward coextensive with and actually defining axis 22. The radiating cone 14 is supported to and around this tower by means of a lowermost triangular base 41 (FIGS. 4A and 4B) and an uppermost hexagonal rim 42 (FIG. 3), six identical catenary assemblies 44 (also FIG. 3) and a series of guy wires 46 (FIG. 1). The triangular base 41 is positioned on and actually may form part of tower 40 a predetermined distance above ground plane 12 so as to define the apex 20 of radiating cone 14. The rim 42 which will be described in more detail hereinafter is disposed concentrically around tower 40 a predetermined distance above plate 41 and defines the base 24 of the radiating cone. The guy wires 46*a* and 46*b* respectively extend from the rim to the ground plane and from the rim to the top of tower 40 for holding the rim in place. The remaining guy wires 46*c* extend between different points on the tower and ground plane 12 for aiding in maintaining the tower in its vertical position.

Figure 5:
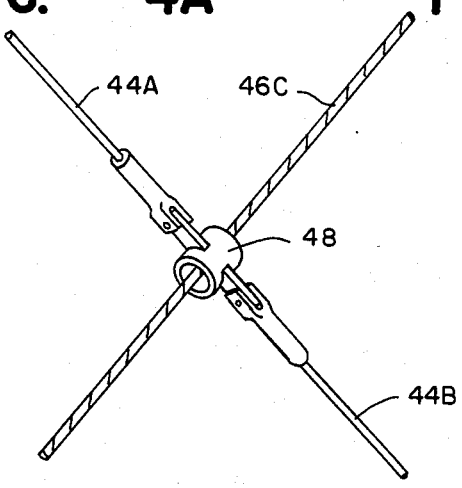
FIG. 5 is an enlarged detailed view of a feature of the antenna taken generally along line 5—5 in FIG. 1.

The six catenary assemblies extend between plate 40 and rim 42 in equally circumferentially spaced relationship to one another around the tower and serve to maintain the radiators 18 in the electrically insulated, spiral relationship described above without interferring with any of the guy wires. This is best illustrated in FIGS. 5, 7 and 8. For example, as best seen in FIG. 5, each catenary assembly is made up of a number of catenary sections such as the two sections illustrated there. These two sections which are generally indicated at 44*a* and 44*b* are coupled to one another at their adjacent ends by means of a ring coupler 48 which allows a guy wire 46*c* to pass therethrough without interference. Each catenary assembly includes one or more of these ring couplers if a guy wire is to be accommodated in the same way. Thus, each catenary assembly may include one or more catenary sections joined by cooperating ring couplers or none at all if there is no interference with the guy wires.

FIGS. 7 and 8 illustrate how a catenary assembly, actually one section thereof, supports a segment of one of the radiators for example, radiator 18*c*. As seen there, at the point along the catenary section where the radiator is to be supported a coupling mechanism 50 is fixedly positioned. As best seen in FIG. 8, this coupling mechanism includes a U-shaped groove 52 disposed below the catenary section and facing up the latter. At that point, radiator 18*c* carries a connecting cylinder 54 which is configured to fit within groove 52. This type of coupling means is provided at each point along each catenary intersected by each of the radiators 18 so as to maintain the desired spiral configuration.

By utilizing the above-described combination of components making up support arrangement 16, it is only necessary to use a single tower for supporting a radiating cone. This is to be contrasted with, for example, the network of towers required by the previously recited TCI 540 antenna arrangement. Also, the support arrangement 16 lends itself to providing a second identical inverted radiating cone 14 around tower 40 and above the cone illustrated for achieving higher gain at higher frequencies. A second cone would be supported to tower 40 in the same way as the initially described cone and therefore would require its own bottom plate 40, its own top rim 42, and its own catenary assemblies 44. It would also more than likely require its own guy wires, although the two cones could possibly share some. The second cone is shown diagrammatically by dotted lines in FIG. 1 at 45.

It is to be understood that while log-spiral 14 is preferably supported by a single tower (in combination with catenaries and guy wires), a plurality of towers could be used. Also, because of the catenary supports, the log-spiral is not a true cone but functions as one for purposes of the present invention.

Referring to FIG. 9, the radiating log-spiral 14 illustrated in detail in FIGS. 1 and 3 is shown only diagrammatically to illustrate its dimensions and the pitch angle of its windings. More specifically, the apex 20 is shown defining a preselected apex angle $\beta$ with its central axis 22 and the spiral windings are shown defining a preselected pitch angle $\alpha$ with the axis. The height of the cone from its apex to its base is defined by D and its maximum diameter at its base is defined by D'. Applicants have found that the pitch angle $\alpha$ and the cone angle $\beta$ can be selected to provide horizontal polarization of the low angle radiation pattern when the antenna is operating in its low angle mode. This is to be contrasted with prior art four element (radiator) spiral cones which have been known to provide circular polarization. This has been due in large part to the relatively small cone angles and pitch angles selected. In actuality, predominant horizontal polarization is achieved by the antenna in its low angle mode. There is a small vertical component present which means that the radiation pattern is more precisely elliptically polarized (e.g., predominantly horizontally polarized).

In an actual working embodiment of the present invention, the pitch angle has been selected to be approximately 80° and the cone angle has been selected to be approximately 45°. In the same embodiment, the cone is 120 feet high (dimension D) and its base has a diameter of 182 feet (its dimension D'). This particular log-spiral provides the low angle pattern illustrated in FIG. 2 with predominantly horizontal polarization. It is to be understood, however, that the present invention is not limited to these dimensions or angles and that, in fact, the angles may vary depending upon the dimensions D and D' in order to provide horizontal polarization. Also, the equivalent cone and pitch angle for a given radiating section could vary to some extent without departing from the invention.

Assuming that radiating cone 14 has fixed dimensions D and D' and assuming that the rim 42 (see FIG. 3) defining the base of the cone is electrically non-conductive, that is, constructed of dielectric structural cables or similar means, then the antenna will display a particular low frequency cut-off which is dependent upon the maximum diameter of the cone, e.g., D'. Under these circumstances, in order to extend the low frequency cut-off to lower frequencies, it would be necessary to increase the maximum diameter of the cone. However, in accordance with the present invention, by providing a specifically designed rim and connecting it with the radiators in a specific way to be described below, it is possible to extend the low frequency cut-off to lower frequencies without increasing the base of the cone.

Figure 6:
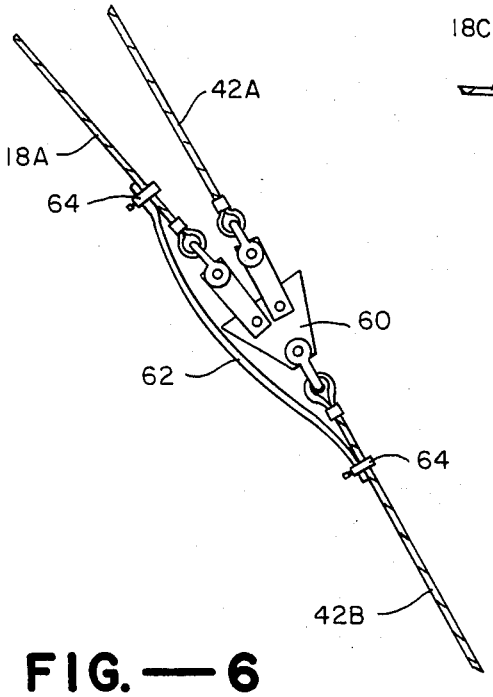
FIG. 6 illustrates another enlarged detail of the antenna taken generally along line 6—6 in FIG. 3.

Referring specifically to FIG. 6, two sections of the specifically designed rim 42 are illustrated. These sections, which are provided with the reference numerals 42*a* and 42*b* for purposes of description, are connected together by a dielectric coupling 60. The same coupling is used to join the uppermost end of radiator 18*a* to the rim. Thus, coupling 60 not only serves as a means of interconnecting rim sections 42*a* and 42*b* with one another and also with the uppermost end of radiator 18*a*, but it also serves as a means of electrically insulating these rim sections and the radiator from one another. Similar dielectric couplings are provided for connecting radiator 18*b* to the rim sections 42*b* and 42*c*, radiator 18*c* to rim sections 42*c* and 42*d*, and radiator 18*d* to rim sections 42*d* and 42*a* (see FIG. 3).

In accordance with the present invention, the radiator 18*a* is electrically connected to rim section 42*b* by means of an electrically conductive jumper cable 62 and cooperating clamps 64. Similar jumper cables are utilized to electrically connect the radiators 18*b*, 18*c* and 18*d* to rim sections 42*c*, 42*d* and 42*a*, respectively. Because these rim sections are electrically insulated from one another, each radiator is electrically connected only to the rim section joining it by means of its particular jumper cable. There are only four such sections making up the entire rim as noted above. Thus, as illustrated in FIG. 3, radiator 18*a* is electrically connected only to rim section 42*b* which extends from rim section 42*a* to rim section 42*c*. The radiator 18*b* is electrically connected only to rim section 42*c* which, in turn, extends to rim section 42*d*. The radiator 18*c* is electrically connected only to this latter rim section. Finally, the radiator 18*d* is electrically connected only to rim section 42*a* which extends between rim sections 42*d* and 42*b*. As a result of these various connections, each radiator is operatively extended an amount equal to the length of its connected rim section and thereby is able to extend the low frequency cut-off of the antenna to lower frequencies by a 90° conductive segment of the rim and therefore the base of the cone does not have to be increased. In other words, the rim itself which primarily serves as a structural member is also used as radiator extensions sufficient to extend the low frequency cut-off of the antenna without increasing the dimensions of the radiating cone.

The overall antenna 10 has been described as including a radiating section 14 and a support section 16, the latter including a support tower 40. With the exception of this tower (and additional towers, if used), the antenna could be initially provided in kit form. In this form, the individual components making up the radiating section and those components making up the support section (except for the tower or towers) would be initially provided separately, that is, unconnected with one another or at most connected together in subsections. The antenna could then be assembled at its ultimate site.

What is claimed is:

1. An antenna, comprising: first, second, third and fourth wire radiators; means for supporting said radiators in electrically insulated relationship to one another above a horizontal ground plane and around the outer surface of an imaginary inverted cone having its apex located a fixed distance above said plane and its central axis extending vertically upward therefrom, said first, second, third and fourth radiators being supported so as to define successively interlaced first, second, third and fourth conical spiral windings, respectively, beginning at the lowermost ends of the radiators adjacent the apex of said cone, said lowermost ends being circumferentially spaced 90° from each other about said central axis; means for providing first and second alternating currents having the same amplitude and a given frequency but 180° out of phase with one another; and means for simultaneously electrically connecting said first current to the lowermost ends of said first and second radiators and said second current to the lowermost ends of said third and fourth radiators, whereby to cause said radiators to produce a high angle radiation pattern relative to said horizontal ground plane.

2. An antenna according to claim 1 wherein said connecting means includes switch means movable between a first operating mode for simultaneously connecting said first current to the lowermost ends of said first and second radiators and said second current to the lowermost ends of said third and fourth radiators to provide said high angle radiation pattern and a second operating mode for simultaneously connecting said first current to the lowermost ends of said first and third radiators and said second current to the lowermost ends of said second and fourth radiators whereby to cause said radiators to produce a low angle radiator pattern relative to said horizontal plane.

3. An antenna according to claim 2 wherein said apex of said imaginary cone defines a preselected cone angle with its central axis and wherein said spiral windings define a preselected pitch angle with said axis, said cone and pitch angles being selected such that said low angle radiation pattern is predominantly horizontally polarized.

4. An antenna according to claim 3 wherein said cone angle is approximately 45° and wherein said pitch angle is approximately 80°.

5. An antenna according to claim 2 wherein said means for supporting said radiators includes a horizontally extending circumferential rim forming the inverted base end of said cone, said rim being formed primarily from electrically conductive structural wires connected in end-to-end relationship to one another by electrical insulating means between adjacent ends of adjacent wires whereby to electrically insulate the wires from one another, said supporting means also including means for structurally connecting each of said radiators at its uppermost end to said rim and means for electrically connecting each of said radiators to a respective one of said wires such that each wire functions as a radiator extension of its radiator for reducing the low frequency cut-off of the antenna.

6. An antenna according to claim 5 wherein said four wires are of equal lengths and are connected together at adjacent ends by dielectric coupling members serving as said insulating means, wherein said means for structurally connecting each of said radiators to said rim including means connecting the uppermost end of each of said radiators to a respective one of said coupling members, and wherein said means for electrically connecting each of said radiators to a respective one of said wires includes an electrical jumper wire.

7. An antenna according to claim 2 wherein said radiators are able to provide said high angle radiation pattern within a bandwidth of 2 to 30 MHz and said low angle radiation pattern within a bandwidth of 4 to 30 MHz.

8. An antenna according to claim 2 wherein said spiral windings define conical logarithmic spirals.

9. An antenna according to claim 2 wherein said inverted cone has a cross-sectional configuration normal to its central axis in the shape of a hexagon.

10. An antenna according to claim 2 wherein said supporting means includes a single vertical tower coextensive with the central axis of said cone and serving as the primary structural support for said radiators.

11. A broadband antenna, comprising: first, second, third and fourth wire radiators; means for supporting said radiators in electrically insulated relationship to one another above a horizontal ground plane and around the surface of an imaginary inverted cone having its apex located a fixed distance above said plane and its central axis extending vertically upward therefrom, said first, second, third and fourth radiators being supported so as to define successively interlaced first, second, third and fourth spiral windings, respectively, beginning at the lowermost ends of the radiators adjacent the apex of said cone, said lowermost ends being circumferentially spaced 90° from each other about said central axis; means for providing first and second alternating currents having the same amplitude and a given frequency but 180° out of phase with one another; and means for simultaneously electrically connecting said first current to the lowermost ends of said first and third radiators and said second current to the lowermost ends of said second and fourth radiators whereby to cause said radiators to produce a low angle radiation pattern relative to said horizontal ground plane, said imaginary cone defining a preselected cone angle axis and the spiral windings defining a preselected pitch angle with said central axis such that said low angle radiation pattern is predominately horizontally polarized.

12. A broadband antenna, comprising first, second, third and fourth wire radiators, means for supporting said radiator in electrically insulated relationship to one another above a horizontal ground plane and around the surface of an imaginary inverted cone having its apex located a fixed distance above said plane and its central axis extending vertically upward therefrom, said first, second, third and fourth radiators being supported so as to define successively interlaced first, second, third, and fourth spiral windings, respectively, beginning at the lowermost ends of the radiators adjacent the apex of said cone and ending at the uppermost ends of the radiators adjacent the base of the cone, said lowermost ends being circumferentially spaced 90° from each other about the central axis of the cone at its apex, and said uppermost ends also being circumferentially spaced 90° from each other about the central axis of said cone about its base; means for providing first and second alternating currents having the same amplitude and a given frequency but 180° out of phase with one another; and means for simultaneously electrically connecting said first and second currents to preselected ones of said radiators in order to cause the latter to produce a given radiation pattern relative to said horizontal ground plane at the frequency within a given bandwidth; said means for supporting said radiators including a horizontally oriented circumferential rim at the base end of said cone for aiding in supporting said radiators, said rim including means for extending the radiating length of each of said radiators sufficient to reduce the low frequency cut-off of the antenna without increasing the maximum horizontal extent of said cone beyond said rim.

13. An antenna according to claim 12 wherein said rim consists essentially of four electrically conductive structural wires of equal length connected in end-to-end relationship to one another by dielectric coupling member, wherein the uppermost end of each of said radiators is positioned adjacent a corresponding one of said dielectric coupling members, wherein said means for supporting said radiators includes means for connecting the uppermost end of each radiator with its corresponding dielectric coupling member, and wherein said means for extending each radiator includes an electrical jumper cable connected between that radiator and a specific adjacent one of said wires.

14. A broadband antenna, comprising: a first group of first, second, third and fourth wire radiators; a second group of first, second, third and fourth wire radiators; means for supporting the radiators in each of said groups in electrically insulated relationship to one another above a horizontal ground plane and around the surface of an imaginary inverted cone having its apex located a fixed distance above said plane and its central axis extending vertically upward therefrom, the cone including said first group of radiators and the cone including the second group of radiators being disposed in stacked relationship so as to define colinear central axes, the first, second, third and fourth radiators in each group being supported so as to define successively interlaced first, second, third and fourth spiral windings, respectively, beginning at the lowermost ends of its radiators adjacent the apex of its cone, said lowermost ends being circumferentially spaced 90° from each other about the central axis of its cone; means for providing first and second alternating currents having the same amplitude and a given frequency for 180° out of phase with one another; and means for simultaneously electrically connecting said first and second currents to the lowermost ends of the radiators in each of said groups in a predetermined way which causes the radiators to produce a given radiation pattern relative to said horizontal ground plane.

15. An antenna according to claim 14 wherein said means for supporting the radiators in each of said groups includes a common vertical support tower coextensive with the colinear axes of said cones.

16. A broadband, multi-range omni-directional antenna comprising:

first, second, third and fourth wire radiators;

means for supporting said radiators in electrically insulated relationship to one another above a horizontal ground plane and around the surface of an imaginary inverted cone having its apex located a fixed distance above said plane and its central axis extending vertically upward therefrom, said first second, third and fourth radiators being supported so as to define successively interlaced first, second, third and fourth logarithmic spiral windings, respectively, beginnning at the lowermost ends of the radiator adjacent the apex of said cone and ending at the uppermost ends of the radiators adjacent the base of said cone, said lowermost ends being circumferentially spaced 90° from each other about said central axis at said apex and said uppermost ends being circumferentially spaced 90° from each other about said central axis at said base, said supporting means including a horizontally oriented structural rim forming the base of said inverted cone and consisting essentially of four equal electrically conductive circumferential segments separated from one another by four dielectric coupling members and said supporting means also including a single central structural tower coextensive with the central axis of said cone and serving as the primary structural member for said radiators; means for providing first and second alternating currents having the same amplitude and a given frequency within a bandwidth of about 2 MHz to about 30 MHz but 180° out of phase with one another; means including a switch movable between a first operating mode for simultaneously electrically connecting said first current to the lowermost ends of said first and second radiators and said second current to the lowermost ends of said third and fourth radiators, whereby to cause said radiators to produce a high angle radiation pattern relative to said horizontal ground plane and a second operating mode for simultaneously electrically connecting said first current to the lowermost ends of said first and third radiators and said second current to the lowermost ends of said second and fourth radiators whereby to cause said radiators to produce a low angle radiation pattern relative to said horizontal plane, the apex of said imaginary cone defining a preselected cone angle with its central axis and the spiral windings defining a preselected pitch angle with said axis such that said low angle radiation pattern is predominately horizontally polarized; and means for electrically connecting said first, second, third and fourth radiators with said four electrically conductive wires, respectively, so as to extend the radiation capabilities of said radiators sufficient to reduce the low frequency cut-off of the antenna without increasing the size of said base.

* * * * *